US009824620B2

(12) United States Patent
Guo et al.

(10) Patent No.: US 9,824,620 B2
(45) Date of Patent: Nov. 21, 2017

(54) DRIVING METHOD FOR PIXEL ARRAY AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Renwei Guo, Beijing (CN); Xue Dong, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 136 days.

(21) Appl. No.: 14/443,757

(22) PCT Filed: Nov. 20, 2014

(86) PCT No.: PCT/CN2014/091788
§ 371 (c)(1),
(2) Date: May 19, 2015

(87) PCT Pub. No.: WO2015/124005
PCT Pub. Date: Aug. 27, 2015

(65) Prior Publication Data

US 2015/0371583 A1 Dec. 24, 2015

(30) Foreign Application Priority Data

Feb. 21, 2014 (CN) ..... 2014 1 0060449

(51) Int. Cl.
*G09G 3/20* (2006.01)
*G09G 3/36* (2006.01)

(52) U.S. Cl.
CPC ..... *G09G 3/2074* (2013.01); *G09G 3/2003* (2013.01); *G09G 3/3607* (2013.01);
(Continued)

(58) Field of Classification Search
None
See application file for complete search history.

(56) References Cited

U.S. PATENT DOCUMENTS 6,088,062 A 7/2000 Kanou et al.
2002/0154152 A1* 10/2002 Tezuka ..... G09G 3/3607 345/690
2013/0215360 A1* 8/2013 Pollack ..... G09G 3/3413 349/61

FOREIGN PATENT DOCUMENTS

WO 2012/077564 A1 6/2012

OTHER PUBLICATIONS

Extended Search Report issued in corresponding European application No. 14861143.7 dated Jul. 8, 2016.

* cited by examiner

*Primary Examiner* — Joseph Haley
*Assistant Examiner* — Emily Frank
(74) *Attorney, Agent, or Firm* — Nath, Goldberg & Meyer; Joshua B. Goldberg

(57) ABSTRACT

The present invention provides a driving method for pixel array, comprising steps of: dividing a to-be-displayed image into multiple theoretical pixel units; calculating an actual brightness value of each actual sub-pixel; and enabling brightness of each actual sub-pixel to reach the actual brightness value. The step of calculating an actual brightness value of each actual sub-pixel comprises: finding a first theoretical sub-pixel; inserting multiple virtual sub-pixels having the same color as the first theoretical sub-pixel between the first theoretical sub-pixel and at least one
(Continued)

adjacent theoretical sub-pixel; and adding a portion of the theoretical brightness value of the first theoretical sub-pixel and a portion of virtual brightness value(s) of virtual sub-pixel(s) whose position(s) corresponds to that of the to-be-calculated actual sub-pixel to obtain the actual brightness value of the to-be-calculated actual sub-pixel. The present invention further provides a display device to which the above driving method is applicable.

13 Claims, 7 Drawing Sheets

(52) U.S. Cl.
CPC ..... *G09G 2300/0452* (2013.01); *G09G 2300/0465* (2013.01); *G09G 2320/0626* (2013.01); *G09G 2340/0407* (2013.01); *G09G 2340/0457* (2013.01); *G09G 2360/16* (2013.01)

| | | | | | |
|---|---|---|---|---|---|
| | T1 | T2 | | | |
| n=0 | [ a; | b; ] | | | |
| | T1 | V11 | T2 | | |
| n=1 | [ a; | (a+b)/2; | b; ] | | |
| | T1 | V21 | V22 | T2 | |
| n=2 | [ a; | [a+(a+b)/2]/2; | [(a+b)/2+ b]/2; | b; ] | |
| | T1 | V32 | V32 | V33 | T2 |
| n=3 | [ a; | {a+[a+(a+b)/2]/2}/2; | {[a+(a+b)/2]/2+ [(a+b)/2+ b]/2}/2; | {[(a+b)/2+ b]/2+b}/2; | b; ] |

.....

DRIVING METHOD FOR PIXEL ARRAY AND DISPLAY DEVICE

FIELD OF THE INVENTION

The present invention relates to the field of display technology, and particularly relates to a driving method for a pixel array and a display device to which the driving method is applicable.

BACKGROUND OF THE INVENTION

In a current display panel, as a common pixel design, three sub-pixels (including a red sub-pixel, a green sub-pixel and a blue sub-pixel, as shown in FIG. 1) or four sub-pixels (including a red sub-pixel, a green sub-pixel, a blue sub-pixel and a white sub-pixel) constitute one pixel for display, and physical resolution is the visual resolution.

If pixel per inch (PPI) of a display panel is small, a user would obviously feel a granular sensation (i.e., edges of a displayed image are not smooth, but serrated) when watching a display screen. With users' increasing demand on viewing experience of the display screen, the PPI of the display panel needs to be increased. An increase in PPI of the display panel may add difficulty to a manufacturing process of the display panel.

It has become an urgent technical problem in the field how to reduce the granular sensation of the display panel to achieve a display effect of a display panel with higher resolution in the same size, without adding difficulty to the manufacturing process (i.e., without increasing PPI).

SUMMARY OF THE INVENTION

An object of the present invention is to provide a driving method for a pixel array and a display device to which the driving method is applicable. By using the driving method to drive the pixel array, the granular sensation of the display panel comprising the pixel array can be reduced, and a display effect of a display panel with higher resolution in the same size is achieved.

According to an aspect of the present invention, there is provided a driving method for a pixel array, the pixel array comprises a plurality of actual pixel units, each of which comprises a plurality of actual sub-pixels having different colors, an horizontal-to-vertical ratio of each actual sub-pixel is in the range of 1:2 to 1:1, and the driving method comprises steps of: dividing an image to be displayed into a plurality of theoretical pixel units, each of which comprises a plurality of theoretical sub-pixels having different colors, and calculating a theoretical brightness value of each theoretical sub-pixel; calculating an actual brightness value of each actual sub-pixel; and inputting a signal to each actual sub-pixel so that brightness of each actual sub-pixel reaches the calculated actual brightness value. The step of calculating an actual brightness value of each actual sub-pixel comprises sub-steps of: finding, in the image to be displayed, a first theoretical sub-pixel whose position in the image to be displayed corresponds to position of the actual sub-pixel to be calculated in the pixel array; inserting at least one virtual sub-pixel having the same color as the first theoretical sub-pixel between the first theoretical sub-pixel and at least one adjacent theoretical sub-pixel, wherein the adjacent theoretical sub-pixel is a theoretical sub-pixel adjacent to the first theoretical sub-pixel among all theoretical sub-pixels having the same color and in the same row as the first theoretical sub-pixel; and obtaining, as the actual brightness value of the actual sub-pixel to be calculated, a weighted sum of the theoretical brightness value of the first theoretical sub-pixel and an virtual brightness value of the virtual sub-pixel whose position corresponds to that of the actual sub-pixel to be calculated, wherein the virtual brightness value of the virtual sub-pixel is a weighted sum of the theoretical brightness value of the first theoretical sub-pixel and the theoretical brightness value of corresponding adjacent theoretical sub-pixel.

According to an embodiment of the present invention, the virtual sub-pixel may be inserted between the first theoretical sub-pixel and the adjacent theoretical sub-pixel arranged at a side of the first theoretical sub-pixel. When the first theoretical sub-pixel has two adjacent theoretical sub-pixels, virtual sub-pixels may be inserted between the first theoretical sub-pixel and the adjacent theoretical sub-pixels arranged at both sides of the first theoretical sub-pixel.

According to an embodiment of the present invention, the virtual brightness value of the virtual sub-pixel may be calculated according to the following formula:

$$V_{ni}=a_iT_1+b_iT_2,$$

wherein, i=1, . . . , n; n is the number of the virtual sub-pixel inserted between the first theoretical sub-pixel and one adjacent theoretical sub-pixel; $V_{ni}$ is the virtual brightness value of the i-th virtual sub-pixel among the n virtual sub-pixels; $a_i+b_i=1$, $a_i$, $b_i>0$, when $i<n/2$, $a_i>b_i$, when $i>n/2$, $a_i<b_i$, when $i=n/2$, $a_i=b_i$; $T_1$ is the theoretical brightness value of the theoretical sub-pixel on the left side of the virtual sub-pixel to be calculated; and $T_2$ is the theoretical brightness value of the theoretical sub-pixel on the right side of the virtual sub-pixel to be calculated.

According to an embodiment of the present invention, when n=1, $V_{11}=\frac{1}{2}(T1+T2)$; when n>1, $V_{n1}=1/2*(T_1+V_{(n-1)1})$, $V_{ni}=\frac{1}{2}*(V_{(n-1)(i-1)}+V_{(n-1)i})$ $(1<i<n)$, $V_{nn}=\frac{1}{2}*(T2+V_{(n-1)(n-1)})$.

According to an embodiment of the present invention, n may be any one of 1 to 5.

According to an embodiment of the present invention, length of the theoretical sub-pixel in a longitudinal direction may be equal to that of the actual sub-pixel in a longitudinal direction, and the horizontal-to-vertical ratio of each actual sub-pixel may be 1:2 or 1:1.

According to an embodiment of the present invention, each actual pixel unit may comprise three actual sub-pixels having colors different from each other, and the horizontal-to-vertical ratio of each actual sub-pixel may be 2:3.

According to an embodiment of the present invention, the pixel array may comprise a plurality of pixel unit sets, each of which may comprise two adjacent actual pixel units in a same column, and left boundaries of the actual sub-pixels of the actual pixel unit in a lower row may be aligned with midpoints of bottom boundaries of the actual sub-pixels of the actual pixel unit in an upper row.

According to an embodiment of the present invention, the pixel array may comprise a plurality of pixel unit sets, each of which may comprise two adjacent actual pixel units in a same column, and left boundaries of the actual sub-pixels of the actual pixel unit in an upper row may be aligned with midpoints of top boundaries of the actual sub-pixels of the actual pixel unit in a lower row.

According to another aspect of the present invention, there is provided a display device, which comprises a display panel comprising a pixel array, wherein the pixel array comprises a plurality of actual pixel units, each of which comprises a plurality of actual sub-pixels having different colors, an horizontal-to-vertical ratio of each actual sub-pixel is in the range of 1:2 to 1:1. The display device further comprises a theoretical brightness value calculation module, an actual brightness value calculation module and a display driving module. The theoretical brightness value calculation module is configured to divide an image to be displayed into a plurality of theoretical pixel units, each of which comprises a plurality of theoretical sub-pixels having different colors, and to calculate a theoretical brightness value of each theoretical sub-pixel. The actual brightness value calculation module is configured to calculate an actual brightness value of each actual sub-pixel. The display driving module is configured to input a signal to each actual sub-pixel so that brightness of each actual sub-pixel reaches the actual brightness value calculated by the actual brightness value calculation module. The actual brightness value calculation module comprises: a position correspondence sub-module configured to find, in the image to be displayed, a first theoretical sub-pixel whose position in the image to be displayed corresponds to position of the actual sub-pixel to be calculated in the pixel array; an insertion sub-module configured to insert at least one virtual sub-pixel having the same color as the first theoretical sub-pixel between the first theoretical sub-pixel and at least one adjacent theoretical sub-pixel, wherein the adjacent theoretical sub-pixel is a theoretical sub-pixel adjacent to the first theoretical sub-pixel among all theoretical sub-pixels having the same color and in the same row as the first theoretical sub-pixel; and a summation sub-module configured to obtain, as the actual brightness value of the actual sub-pixel to be calculated, a weighted sum of the theoretical brightness value of the first theoretical sub-pixel and an virtual brightness value of the virtual sub-pixel whose position corresponds to that of the actual sub-pixel to be calculated, wherein the virtual brightness value of the virtual sub-pixel is a weighted sum of the theoretical brightness value of the first theoretical sub-pixel and the theoretical brightness value of corresponding adjacent theoretical sub-pixel.

The driving method provided by the present invention is applicable to a pixel array with a relatively large width, and can reduce the granular sensation of the display panel comprising the pixel array, thus achieving a display effect of a display panel with higher resolution in the same size.

BRIEF DESCRIPTION OF THE DRAWINGS

The accompanying drawings, constituting a part of the specification, are used for providing a further understanding of the present invention, and explaining the present invention in conjunction with the following specific implementations, rather than limiting the present invention. In the drawings.

DETAILED DESCRIPTION OF THE EMBODIMENTS

Specific implementations of the present invention are described in detail below in conjunction with the accompanying drawings. It should be understood that the specific implementations described herein are merely used for illustrating and explaining the present invention, rather than limiting the present invention.

It should be understood that, the "transverse direction" described herein refers to the horizontal direction in each drawing, and the "longitudinal direction" refers to the vertical direction in each drawing.

Figure 1:
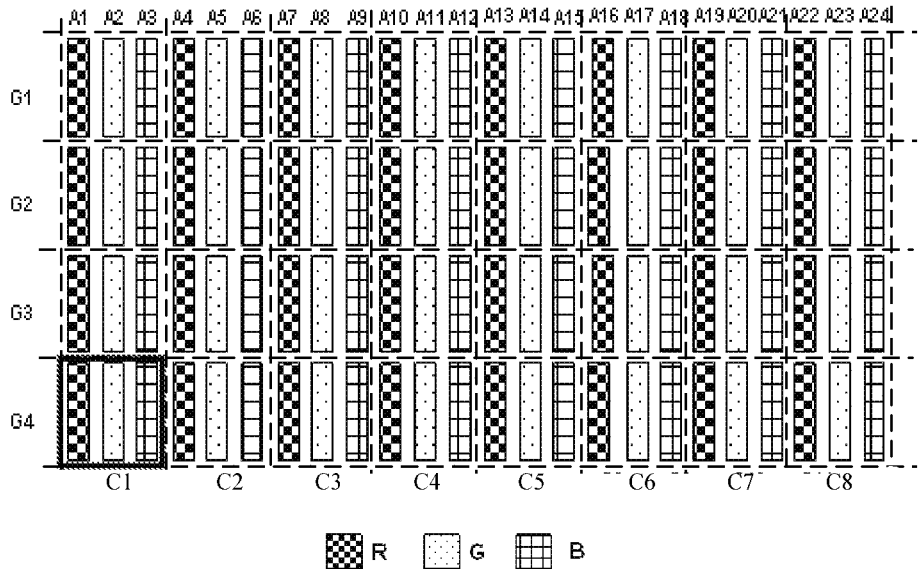
FIG. 1 is a schematic diagram of an existing pixel array, and also illustrates a manner in which a theoretical pixel unit is divided.
Figure 2A:
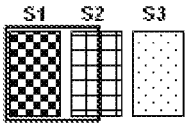
FIGS. 2*a* to 2*d* are schematic diagrams of actual pixel units in a pixel array to which a driving method according to the present invention is applicable.
Figure 2B:
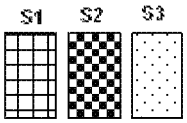
Figure 2C:
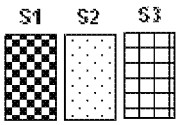
Figure 2D:
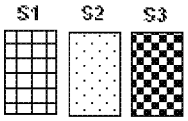
Figure 6:
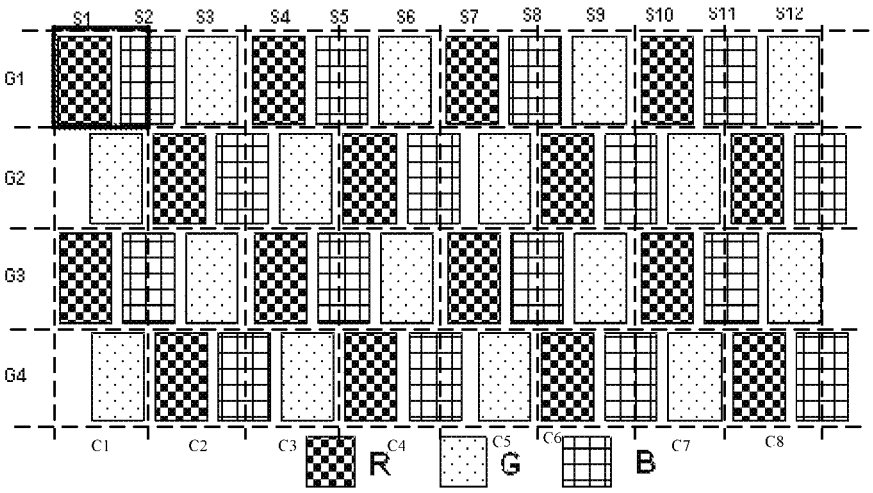
FIG. 6 is a schematic diagram of a pixel array to which a driving method according to the present invention is applicable.

FIG. 1 illustrates a manner in which a theoretical pixel unit is divided. FIG. 6 illustrates a schematic diagram of a pixel array to which a driving method according to the present invention is applicable. As shown in FIG. 1, three theoretical sub-pixels that are sequentially arranged in a same row form one theoretical pixel unit. In FIG. 1, 4 rows and 24 columns of theoretical sub-pixels constitute 4 rows (G1 to G4) and 8 columns (C1 to C8) of theoretical pixel units. Accordingly, as shown in FIG. 6, 4 rows (G1 to G4) and 12 columns (S1 to S12) actual sub-pixels are included in the exemplary pixel array, and three actual sub-pixels that are sequentially arranged in a same row form one actual pixel unit. The area of an image to be displayed is the same as that of the pixel array. The pixel array may be divided into 4 rows and 8 columns of actual pixel corresponding to the theoretical pixel units shown in FIG. 1. The object of the present invention is, for example, to achieve the display effect of the theoretical pixel array comprising theoretical pixel units as shown in FIG. 1 by using the actual pixel array comprising actual pixel units as shown in FIG. 6, i.e., to achieve a display effect with higher resolution.

According to an aspect of the present invention, there is provided a driving method for a pixel array, the pixel array comprises a plurality of actual pixel units, each of which comprises a plurality of actual sub-pixels having different colors, an horizontal-to-vertical ratio of each actual sub-pixel is in the range of 1:2 to 1:1, and the driving method comprises steps of: dividing an image to be displayed into a plurality of theoretical pixel units, each of which comprises a plurality of theoretical sub-pixels having different colors, and calculating a theoretical brightness value of each theoretical sub-pixel; calculating an actual brightness value of each actual sub-pixel; and inputting a signal to each actual sub-pixel so that brightness of each actual sub-pixel reaches the calculated actual brightness value. The step of calculating an actual brightness value of each actual sub-pixel comprises sub-steps of: finding, in the image to be displayed, a first theoretical sub-pixel whose position in the image to be displayed corresponds to position of the actual sub-pixel to be calculated in the pixel array; inserting at least one virtual sub-pixel having the same color as the first theoretical sub-pixel between the first theoretical sub-pixel and at least one adjacent theoretical sub-pixel, wherein the adjacent theoretical sub-pixel is a theoretical sub-pixel adjacent to the first theoretical sub-pixel among all theoretical sub-pixels having the same color and in the same row as the first theoretical sub-pixel; and obtaining, as the actual brightness value of the actual sub-pixel to be calculated, a weighted sum of the theoretical brightness value of the first theoretical sub-pixel and an virtual brightness value of the virtual sub-pixel whose position corresponds to that of the actual sub-pixel to be calculated, wherein the virtual brightness value of the virtual sub-pixel is a weighted sum of the theoretical brightness value of the first theoretical sub-pixel and the theoretical brightness value of corresponding adjacent theoretical sub-pixel.

Compared to the prior art, the driving method according to the present invention is applicable to a pixel array whose sub-pixels have a relatively large width. Generally, length of a theoretical sub-pixel in the longitudinal direction is equal to that of an actual sub-pixel in the longitudinal direction. If each actual sub-pixel in the pixel array has a relatively large width, difficulty in manufacturing the pixel array can be reduced, and both aperture ratio and yield can be improved.

Theoretical brightness values of the respective theoretical sub-pixels are the brightness values of the respective sub-pixels when the pixel array comprising the theoretical pixel units shown in FIG. 1 is used for display. According to an embodiment of the present invention, virtual sub-pixels may be provided between the first theoretical sub-pixel and the adjacent theoretical sub-pixel thereof at equal intervals.

In the present invention, "position of the theoretical sub-pixel in the image to be displayed corresponding to that of the actual sub-pixel to be calculated in the pixel array" refers to that coordinates of the position of the actual sub-pixel to be calculated in the actual pixel array shown in FIG. 6 is the same as or close to coordinates of the position of the theoretical sub-pixel having the same color in the image to be displayed (or in the theoretical pixel array shown in FIG. 1). For example, the theoretical sub-pixel whose position corresponds to that of the actual sub-pixel in row G1, column S1 in FIG. 6 is the theoretical sub-pixel in row G1, column A1 in FIG. 1. Therefore, when calculating the actual brightness value of the actual sub-pixel in row G1, column S1 in the actual pixel array shown in FIG. 6, the theoretical brightness values of the theoretical sub-pixel in row G1, column A1 and adjacent theoretical sub-pixel(s) thereof.

In the present invention, the "adjacent theoretical sub-pixel" refers to a theoretical sub-pixel that is adjacent to the first theoretical sub-pixel among sub-pixels, except theoretical sub-pixel having different colors from the first theoretical sub-pixel, in the row in which the first theoretical sub-pixel is arranged in the theoretical pixel array in FIG. 1. For example, in FIG. 1, the adjacent theoretical sub-pixel of the theoretical sub-pixel in row G1, column A1 is the theoretical sub-pixel in row G1, column A4.

In the present invention, the "virtual sub-pixel whose position corresponds to that of the actual sub-pixel to be calculated" refers to a virtual sub-pixel whose position overlaps (or partially overlaps), in the image to be displayed, with the position of the actual sub-pixel. In this way, the "first theoretical sub-pixel" and "virtual sub-pixel(s) whose position(s) corresponds (correspond) to that of the actual sub-pixel to be calculated" may cover the entire area of the "actual sub-pixel to be calculated" on the image to be displayed.

By driving a pixel array using the above method, the granular sensation of the display panel comprising the pixel array can be reduced, thus achieving a display effect of a display panel with higher resolution in the same size.

As shown in FIG. 1, in the same row, each theoretical sub-pixel has at least one adjacent theoretical sub-pixel. The theoretical sub-pixels in the two columns of theoretical pixel units at the edge each have only one adjacent theoretical sub-pixel, while the theoretical sub-pixels in the other theoretical pixel units each have two adjacent theoretical sub-pixels.

When the first theoretical sub-pixel has only one adjacent theoretical sub-pixel (for example, the first theoretical sub-pixel is in a theoretical pixel unit in column C1 or C8), virtual theoretical sub-pixel(s) is arranged between the first theoretical sub-pixel and the adjacent theoretical sub-pixel.

When the first theoretical sub-pixel has two adjacent theoretical sub-pixels (for example, the first theoretical sub-pixel is in a theoretical pixel unit in any one of columns C2 to C7), virtual theoretical sub-pixel(s) may be inserted between the first theoretical sub-pixel and the adjacent theoretical sub-pixel at any side of the first theoretical sub-pixel, or be inserted between the first theoretical sub-pixel and the adjacent theoretical sub-pixels at both sides of the first theoretical sub-pixel.

The virtual brightness value of a virtual sub-pixel may be calculated according to the following formula:

$$V_{ni}=a_iT_1+b_iT_2, \text{ wherein,}$$

$i=1, \ldots, n$;

n is the number of the virtual sub-pixel inserted between the first theoretical sub-pixel and one adjacent theoretical sub-pixel;

$V_{ni}$ is the virtual brightness value of the i-th virtual sub-pixel among the n virtual sub-pixels;

$a_i+b_i=1$, $a_i$, $b_i>0$, when $i<n/2$, $a_i>b_i$, when $i>n/2$, $a_i<b_i$, and when $i=n/2$, $a_i=b_i$;

$T_1$ is the theoretical brightness value of the theoretical sub-pixel on the left side of the virtual sub-pixel to be calculated; and $T_2$ is the theoretical brightness value of the theoretical sub-pixel on the right side of the virtual sub-pixel to be calculated.

When $i<n/2$, it is indicated that the virtual sub-pixel is closer to the theoretical sub-pixel on the left side thereof, and therefore, the theoretical brightness value of the theoretical sub-pixel on the left has a larger proportion in the virtual brightness value of the virtual sub-pixel (i.e., $a_i>b_i$); on the contrary, when $i>n/2$, it is indicated that the virtual sub-pixel is closer to the theoretical sub-pixel on the right side thereof, and therefore, the theoretical brightness value of the theoretical sub-pixel on the right has a larger proportion in the virtual brightness value of the virtual sub-pixel (i.e., $a_i<b_i$); when $i=n/2$, it is indicated that the virtual sub-pixel is equidistant from the theoretical sub-pixels on the left and right sides thereof, and therefore, the theoretical brightness values of the theoretical sub-pixels on the left and right have the same proportion in the virtual brightness value of the virtual sub-pixel (i.e., $a_i=b_i=½$). How to calculate the coefficients $a_i$ and $b_i$ is explained below.

According to an embodiment of the present invention, when n virtual sub-pixels are inserted between the first theoretical sub-pixel and one adjacent theoretical sub-pixel, if n=1, then $V_{11}=½*(T1+T2)$; if n>1, then $V_{n1}=½*(T_1+V_{(n-1)1})$, $V_{ni}=½*(V_{(n-1)(i-1)}+V_{(n-1)i})$ (1<i<n), and $V_{nn}=½*(T2+V_{(n-1)(n-1)})$.

That is to say, in a case in which a plurality of virtual sub-pixels (i.e., n>1) are inserts between the first theoretical sub-pixel and one adjacent theoretical sub-pixel, when calculating the virtual brightness value of a virtual sub-pixel, a value calculated when n−1 virtual sub-pixels are inserted between the first theoretical sub-pixel and the one adjacent theoretical sub-pixel is used, and in this way, the value calculated when one virtual sub-pixel (i.e., n=1) is inserted between the first theoretical sub-pixel and the one adjacent theoretical sub-pixel is recursively used.

The above process for calculating the virtual brightness value of a virtual sub-pixel is described in detail below in conjunction with FIG. 7.

Figures 7, 8:
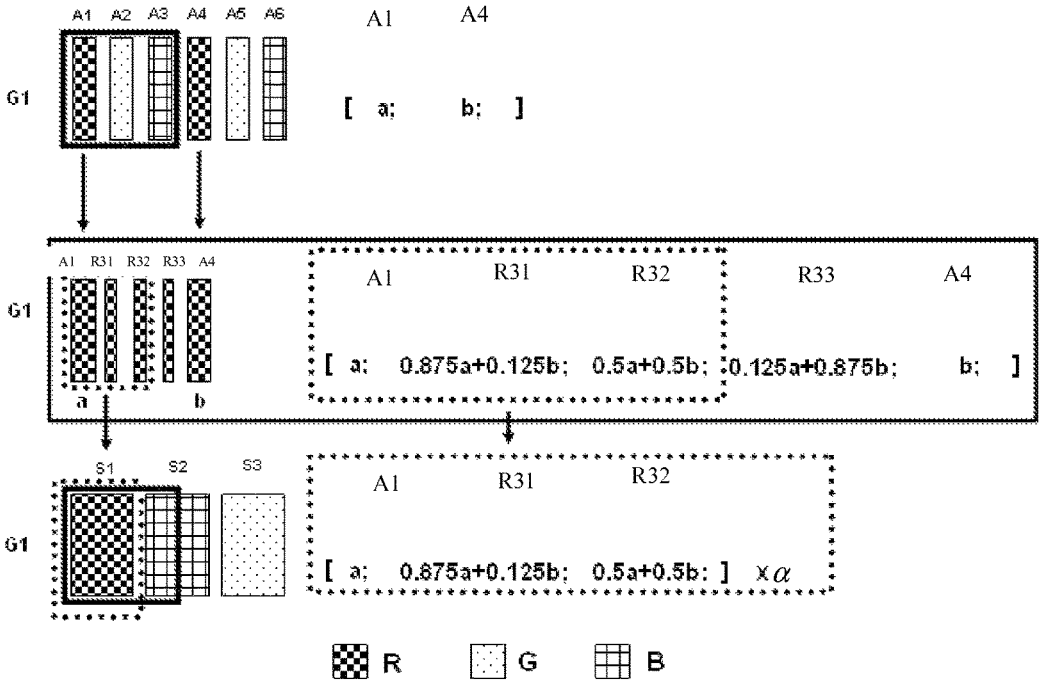
FIG. 7 illustrates an implementation of calculating a virtual brightness value of a virtual sub-pixel.
FIGS. 8 to 10 respectively illustrate steps of calculating actual brightness values of red, blue and green actual sub-pixels when three virtual sub-pixels are inserted between two adjacent theoretical sub-pixels FIGS. 11 to 13 respectively illustrate steps of calculating actual brightness values of red, blue and green actual sub-pixels when four virtual sub-pixels are inserted between two adjacent theoretical sub-pixels.

As shown in FIG. 7, the theoretical brightness value $T_1$ of the first theoretical sub-pixel is a, the theoretical brightness value $T_2$ of the adjacent theoretical sub-pixel is b.

When one virtual sub-pixel (i.e., n=1) is inserted, the virtual brightness value of the virtual sub-pixel is ½*(a+b), that is, $a_i=b_i=½$.

When two virtual sub-pixels (i.e., n=2) are inserted, the virtual brightness values $V_{21}$ and $V_{22}$ of the two virtual sub-pixels are respectively as follows:

$$V_{21}=½*(a+V_{11})=½*[a+½*(a+b)]=0.75a+0.25b; \text{ and}$$

$$V_{22}=½*(b+V_{11})=½*[b+½*(a+b)]=0.25a+0.75b.$$

Therefore, the coefficients $a_1$ and $b_1$ of the first virtual sub-pixel are 0.75 and 0.25, respectively, and the coefficients $a_2$ and $b_2$ of the second virtual sub-pixel are 0.25 and 0.75, respectively.

When three virtual sub-pixels are inserted, the virtual brightness values $V_{31}$, $V_{32}$ and $V_{33}$ of the three virtual sub-pixels are respectively as follows:

$$V_{31}=½*(a+V_{21})=0.875a+0.125b;$$

$$V_{32}=½*(V_{21}+V_{22})=0.5a+0.5b; \text{ and}$$

$$V_{33}=½*(V_{22}+b)=0.125a+0.875b.$$

Therefore, the coefficients $a_1$ and $b_1$ of the first virtual sub-pixel are 0.875 and 0.125, respectively, the coefficients $a_2$ and $b_2$ of the second virtual sub-pixel are 0.5 and 0.5, respectively, and the coefficients $a_3$ and $b_3$ of the third virtual sub-pixel are 0.125 and 0.875, respectively.

The number of the virtual sub-pixels inserted between the first theoretical sub-pixel and the adjacent theoretical sub-pixel is not limited in the present invention. According to embodiments of the present invention, the number of the virtual sub-pixels inserted between the first theoretical sub-pixel and the adjacent theoretical sub-pixel is in the range of 1 to 5, that is, n is any one of 1 to 5. As such, trade-off between amount of calculation and display effect can be achieved.

Figure 3A:
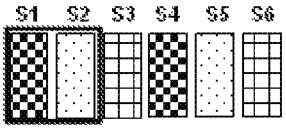
FIGS. 3*a* to 3*c* are schematic diagrams of actual pixel units in a pixel array to which a driving method according to the present invention is applicable.
Figure 3B:
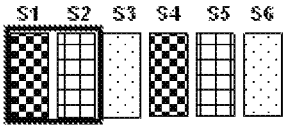
Figure 3C:
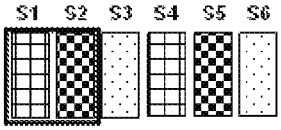
Figure 4A:
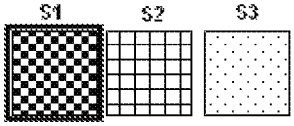
FIGS. 4*a* to 4*f* are schematic diagrams of actual pixel units in a pixel array to which a driving method according to the present invention is applicable.
Figure 4B:
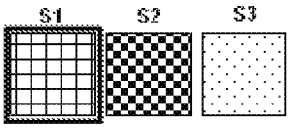
Figure 4C:
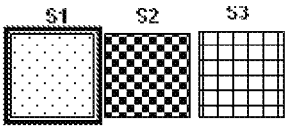
Figure 4D:
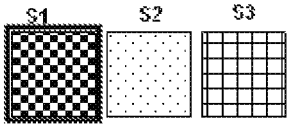
Figure 4E:
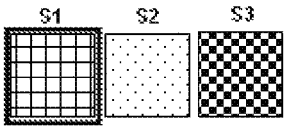
Figure 4F:
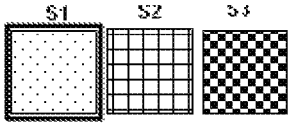
Figure 5A:
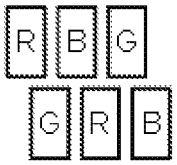
FIGS. 5*a* to 5*f* are schematic diagrams of two actual pixel units, which are adjacent to each other in an up-and-down direction, in a pixel array to which a driving method according to the present invention is applicable.
Figure 5B:
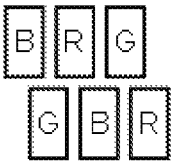
Figure 5C:
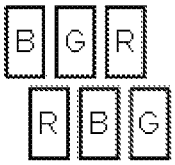
Figure 5D:
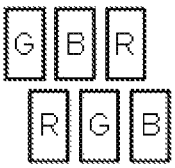
Figure 5E:
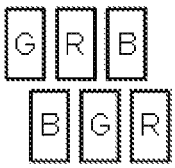
Figure 5F:
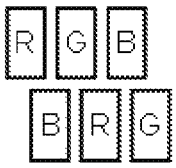

According to an embodiment of the present invention, in an actual pixel array, the horizontal-to-vertical ratio of each actual sub-pixel may be 1:2. In the present invention, the arrangement manner of the actual sub-pixels in the actual pixel unit is not limited, and several different arrangement manners are exemplarily shown in FIGS. 3*a* to 3*c*.

Alternatively, in an actual pixel array, the horizontal-to-vertical ratio of each actual sub-pixel may be 1:1. FIGS. 4*a* to 4*f* exemplarily illustrate several different arrangement manners.

Alternatively, in an actual pixel array, each actual pixel unit may comprise three actual sub-pixels having colors different from each other, and the horizontal-to-vertical ratio of each actual sub-pixel may be 2:3. FIGS. 5*a* to 5*f* exemplarily illustrate several different arrangement manners.

In addition, as shown in FIGS. 5*a* to 5*f*, the actual pixel array may comprise a plurality of pixel unit sets, each of which may comprise two adjacent actual pixel units in a same column. As shown in FIGS. 5*a* to 5*f*, left boundaries of the actual sub-pixels of the actual pixel unit in a lower row may be aligned with midpoints of bottom boundaries of the actual sub-pixels of the actual pixel unit in an upper row. Alternatively, left boundaries of the actual sub-pixels of the actual pixel unit in an upper row may be aligned with midpoints of top boundaries of the actual sub-pixels of the actual pixel unit in a lower row.

Thereinafter, how to drive the actual pixel array shown in FIG. 6 by using the driving method according to the present invention is described in detail below in conjunction with FIGS. 8 to 13.

As shown in FIG. 8, the actual sub-pixel to be calculated is the red actual sub-pixel in row G1, column S1 shown in FIG. 6.

The theoretical sub-pixel corresponding to the actual sub-pixel in row G1, column S1, i.e., the first theoretical sub-pixel is found out in an image to be displayed. According to this embodiment, the first theoretical sub-pixel is the red theoretical sub-pixel in row G1, column A1 shown in FIG. 1. Accordingly, the red theoretical sub-pixel in row G1, column A4 is the adjacent theoretical sub-pixel.

The theoretical brightness value a of the theoretical sub-pixel in row G1, column A1 and the theoretical brightness value b of the theoretical sub-pixel in row G1, column A4 can be known from the above step of dividing the image to be displayed into a plurality of theoretical pixel units. According to this embodiment, three red virtual sub-pixels R31, R32 and R33 are inserted between the first theoretical sub-pixel and the adjacent theoretical sub-pixel. By using the coefficients when n=3 as shown in FIG. 7, it can be known that, the virtual brightness value $V_{31}$ of the virtual sub-pixel R31 is (0.875a+0.125b), the virtual brightness value $V_{32}$ of the virtual sub-pixel R32 is (0.5a+0.5b), and the virtual brightness value $V_{33}$ of the virtual sub-pixel R33 is (0.125a+0.875b). The virtual sub-pixels whose positions correspond to that of the to-be-calculated actual sub-pixel in row G1, column S1 are virtual sub-pixels R31 and R32.

Then, the following formula may be used to calculate the actual brightness value A of the actual sub-pixel to be displayed:

$A=\alpha(a+V_{31}+V_{32})=\alpha(2.375a+0.625b)$, wherein α is a compensation factor, and $0<\alpha\leq 1$. According to this embodiment, $\alpha=⅓$.

Subsequently, a signal is input to the actual sub-pixel in row G1, column S1 shown in FIG. 6 so that brightness of said actual sub-pixel reaches the calculated actual brightness value A.

Figure 9:
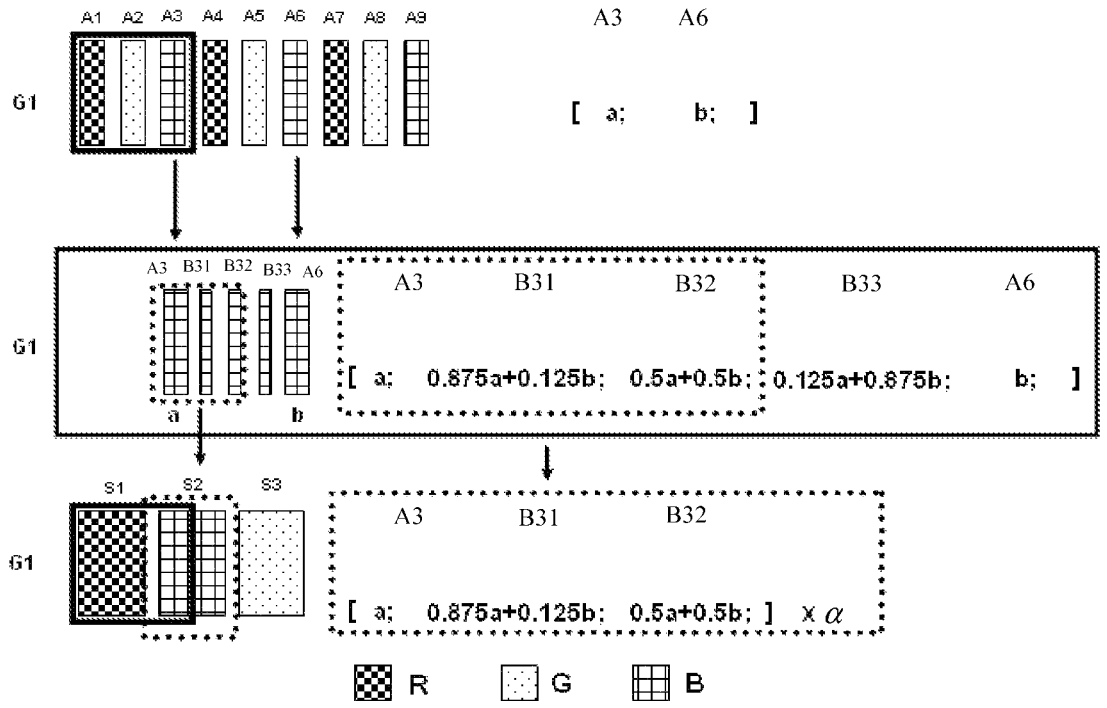

FIG. 9 illustrates a process for calculating the actual brightness value of a blue actual sub-pixel, the process is similar to that described above with reference to FIG. 8, and the detailed description thereof is omitted.

Figure 10:
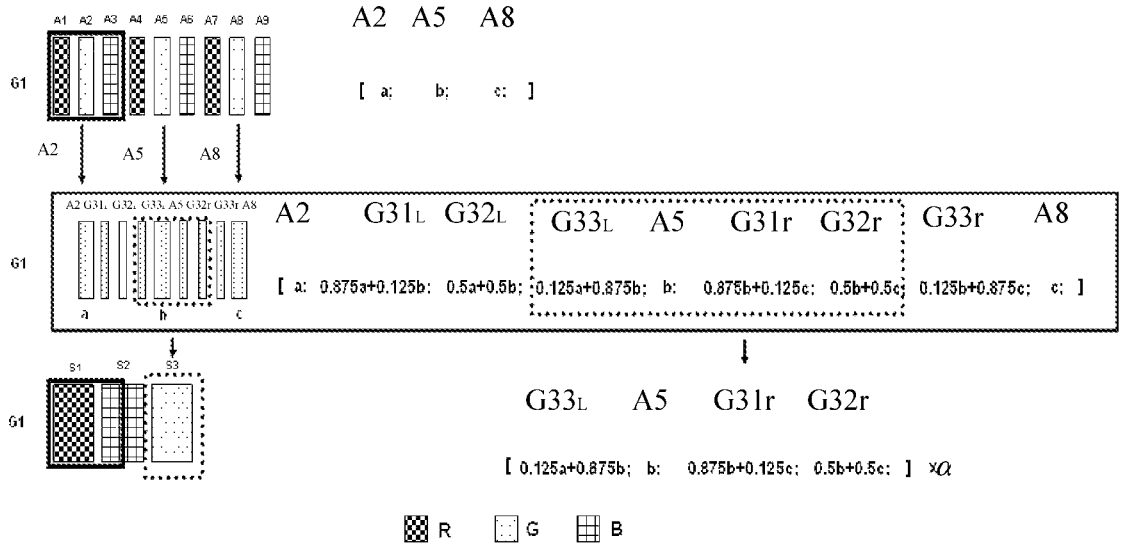

FIG. 10 illustrates a process for calculating the actual brightness value of a green actual sub-pixel. Different from the process described with reference to FIG. 8, three virtual sub-pixels are inserted at each side of the green theoretical sub-pixel in row G1, column A5 (i.e., the first theoretical sub-pixel) shown in FIG. 1. Accordingly, the theoretical sub-pixel in row G1, column A2 and the theoretical sub-pixel in row G1, column A8 are the adjacent theoretical sub-pixels.

Specifically, the theoretical brightness value of the theoretical sub-pixel in row G1, column A5 (i.e., the first theoretical sub-pixel) is b, the theoretical brightness value of the theoretical sub-pixel in row G1, column A2 is a, and the theoretical brightness value of the theoretical sub-pixel in row G1, column A8 is c. Three green virtual sub-pixels $G31_L$, $G32_L$ and $G33_L$ are inserted between the first theoretical sub-pixel and the theoretical sub-pixel in row G1, column A2, and three green virtual sub-pixels $G31_r$, $G32_r$ and $G33_r$ are inserted between the first theoretical sub-pixel and the theoretical sub-pixel in row G1, column A8. The virtual brightness value $V_{31L}$ of the virtual sub-pixel $G31_L$ is (0.875a+0.125b), the virtual brightness value $V_{32L}$ of the virtual sub-pixel $G32_L$ is (0.5a+0.5b), and the virtual brightness value $V_{33L}$ of the virtual sub-pixel $G33_L$ is (0.125a+0.875b). The virtual brightness value $V_{31r}$ of the virtual sub-pixel $G31_r$ is (0.875b+0.125c), the virtual brightness value $V_{32r}$ of the virtual sub-pixel $G32_r$ is (0.5b+0.5c), and the virtual brightness value $V_{33r}$ of the virtual sub-pixel $G33_r$ is (0.125b+0.875c). The virtual sub-pixels whose positions correspond to that of the actual sub-pixel to be calculated are virtual sub-pixels $G33_L$, $G31_r$ and $G32_r$.

Then, the following formula may be used to calculate the actual brightness value A of the actual sub-pixel to be displayed:

$$A=\alpha(a+V_{33L}+V_{31r}+V_{32r})=\alpha(3.25b+0.125a+0.625c),$$

wherein $\alpha$ is a compensation factor, and $0<\alpha\leq 1$. According to this embodiment, $\alpha$ may be ¼.

Subsequently, a signal may be input to the actual sub-pixel in row G1, column S3 shown in FIG. 6 so that brightness of said actual sub-pixel reaches the calculated actual brightness value A.

Figure 11:
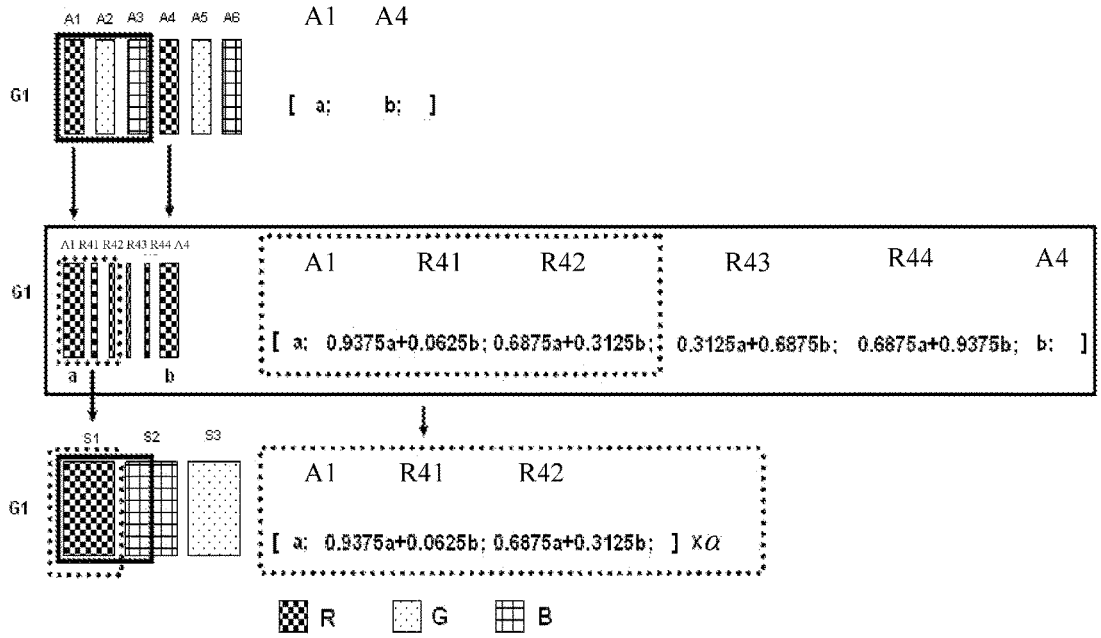
Figure 12:
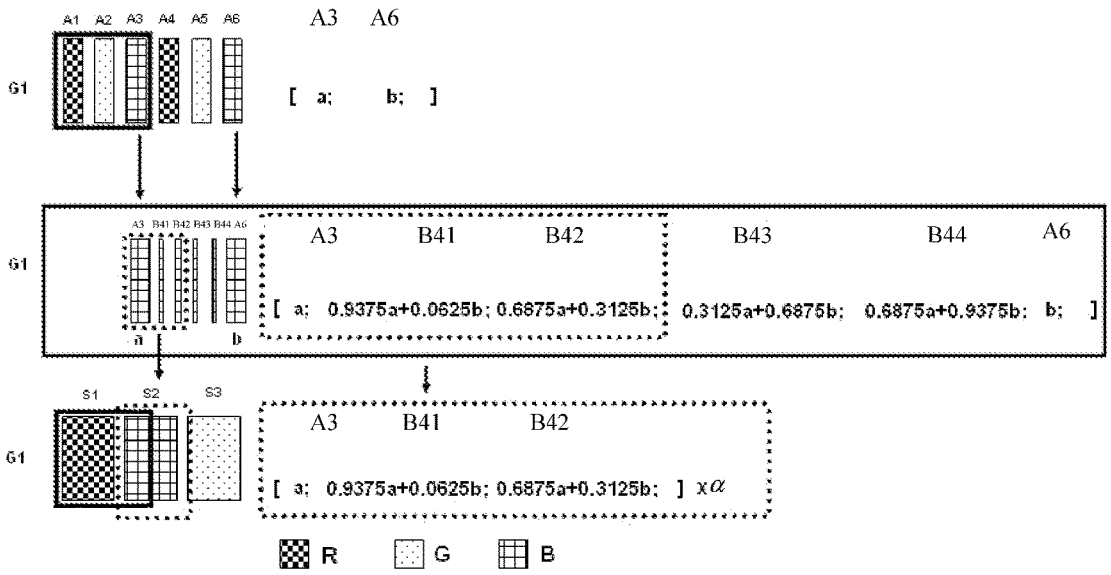
Figure 13:
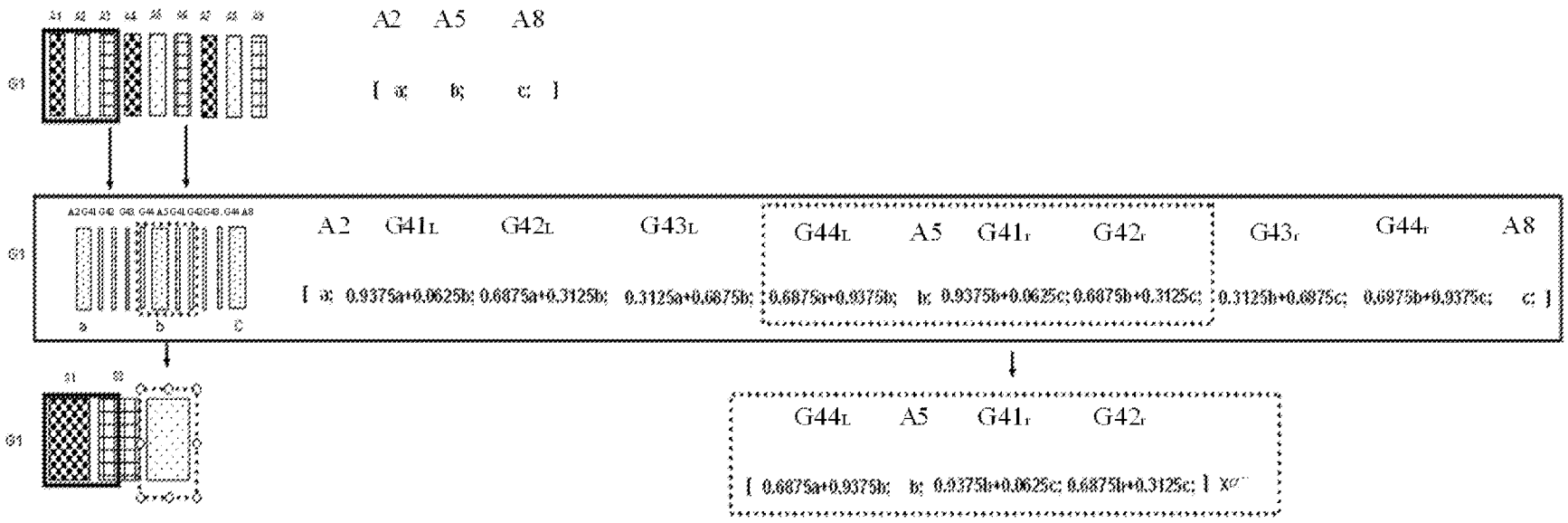

As shown in FIGS. 11 to 13, four virtual sub-pixels are inserted between the first theoretical sub-pixel and the adjacent theoretical sub-pixel. In addition, the calculating processes are similar to those described with reference to FIGS. 8 to 10, and the detailed description thereof is thus omitted. It should be noted that, coefficients for calculating the virtual brightness value of each virtual sub-pixel can be obtained according to the calculating method described with reference to FIG. 7.

A person skilled in the art should understand that, the driving method according to the present invention is not only applicable to the pixel array comprising actual sub-pixels of three colors, but also applicable to a pixel array comprising actual sub-pixels of four colors.

Figure 14:
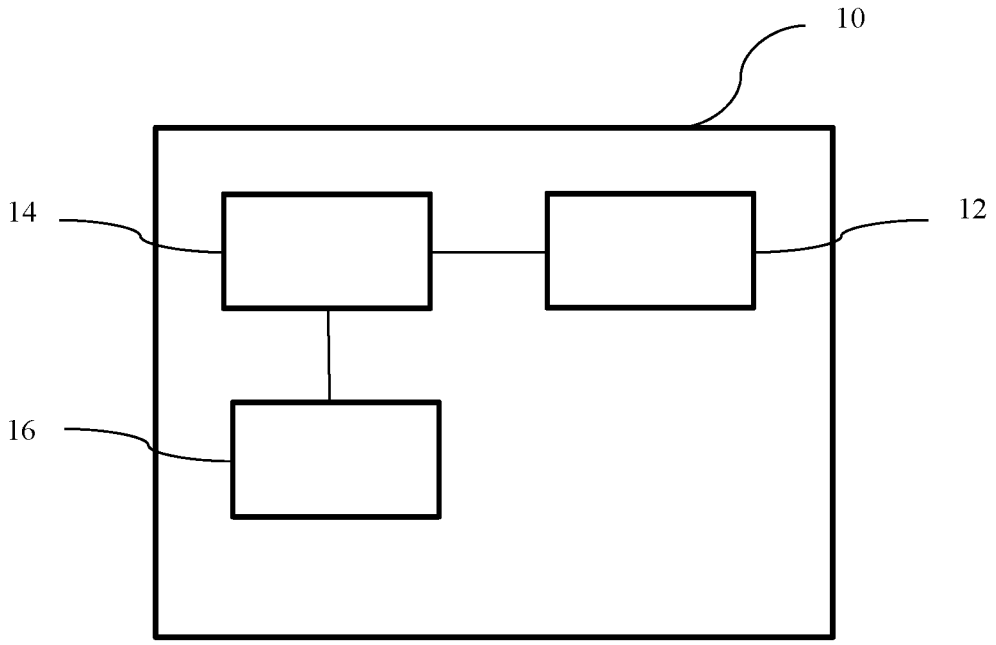
FIG. 14 is a schematic diagram of a display panel according to one embodiment of the present subject matter.

According to another aspect of the present invention, there is provided a display device, which comprises a display panel comprising a pixel array, the pixel array comprises a plurality of actual pixel units, each of which comprises a plurality of actual sub-pixels having different colors, a horizontal-to-vertical ratio of each actual sub-pixel is in the range of 1:2 to 1:1. The display device further comprises a theoretical brightness value calculation module, an actual brightness value calculation module and a display driving module. The theoretical brightness value calculation module is configured to divide an image to be displayed into a plurality of theoretical pixel units, each of which comprises a plurality of theoretical sub-pixels having different colors, and to calculate a theoretical brightness value of each theoretical sub-pixel. The actual brightness value calculation module is configured to calculate an actual brightness value of each actual sub-pixel. The display driving module is configured to input a signal to each actual sub-pixel so that brightness of each actual sub-pixel reaches the actual brightness value calculated by the actual brightness value calculation module. The actual brightness value calculation module comprises: a position correspondence sub-module configured to find, in the image to be displayed, a first theoretical sub-pixel whose position in the image to be displayed corresponds to that of the actual sub-pixel to be calculated in the pixel array; an insertion sub-module configured to insert at least one virtual sub-pixel having the same color as the first theoretical sub-pixel between the first theoretical sub-pixel and at least one adjacent theoretical sub-pixel, wherein the adjacent theoretical sub-pixel is a theoretical sub-pixel adjacent to the first theoretical sub-pixel among all theoretical sub-pixels having the same color and in the same row as the first theoretical sub-pixel; and a summation sub-module configured to obtain, as the actual brightness value of the actual sub-pixel to be calculated, a weighted sum of the theoretical brightness value of the first theoretical sub-pixel and an virtual brightness value of the virtual sub-pixel whose position corresponds to that of the actual sub-pixel to be calculated, wherein the virtual brightness value of the virtual sub-pixel is a weighted sum of the theoretical brightness value of the first theoretical sub-pixel and the theoretical brightness value of corresponding adjacent theoretical sub-pixel. For example, FIG. 14 is a schematic diagram of a display panel according to one embodiment of the present subject matter. The display panel 10 includes a theoretical brightness value calculation module 12, an actual brightness value calculation module 14 and a display driving module 16.

Compared to the display device in the prior art, each actual sub-pixel in the pixel array of the display device according to the present invention may have a larger width, and thus facilitating manufacturing. In addition, the pixel array of the display device according to the present invention has fewer columns, and therefore, fewer data lines can be provided, which further reduce processing difficulty.

The above driving method is applicable to the display device according to the present invention, and therefore, the granular sensation of the display panel comprising the display device according to the present invention can be reduced, thus achieving a display effect of a display device with higher resolution in the same size.

The display device according to the present invention may be any product or component with a display function, such as a liquid crystal panel, an electronic paper, an organic light emitting diode (OLED) panel, a liquid crystal TV, a liquid crystal display, a digital image frame, a mobile phone, a tablet computer, or the like.

It can be understood that, the above implementations are merely exemplary implementations used for explaining the principle of the present invention, but the present invention is not limited thereto. For those skilled in the art, various modifications and improvements may be made without departing from the spirit and essence of the present invention, and these modifications and improvements are also deemed as falling within the protection scope of the present invention.

The invention claimed is:

1. A driving method for a pixel array, wherein the pixel array comprises a plurality of actual pixel units, each of which comprises a plurality of actual sub-pixels having different colors, a horizontal-to-vertical ratio of each actual sub-pixel is in the range of 1:2 to 1:1, and the driving method comprises steps of:

dividing an image to be displayed into a plurality of theoretical pixel units, each of which comprises a plurality of theoretical sub-pixels having different colors, and calculating a theoretical brightness value of each theoretical sub-pixel;

calculating an actual brightness value of each actual sub-pixel; and inputting a signal to each actual sub-pixel so that brightness of each actual sub-pixel reaches the calculated actual brightness value, wherein, the step of calculating an actual brightness value of each actual sub-pixel comprises sub-steps of:

finding, in the image to be displayed, a first theoretical sub-pixel whose position in the image to be displayed corresponds to position of the actual sub-pixel to be calculated in the pixel array;

inserting at least one virtual sub-pixel having the same color as the first theoretical sub-pixel between the first theoretical sub-pixel and at least one adjacent theoretical sub-pixel, wherein the adjacent theoretical sub-pixel is a theoretical sub-pixel adjacent to the first theoretical sub-pixel among all theoretical sub-pixels having the same color and in the same row as the first theoretical sub-pixel; and obtaining, as the actual brightness value of the actual sub-pixel to be calculated, a weighted sum of the theoretical brightness value of the first theoretical sub-pixel and an virtual brightness value of the virtual sub-pixel whose position corresponds to that of the actual sub-pixel to be calculated, wherein the virtual brightness value of the virtual sub-pixel is a weighted sum of the theoretical brightness value of the first theoretical sub-pixel and the theoretical brightness value of corresponding adjacent theoretical sub-pixel.

2. The driving method according to claim 1, wherein, the virtual sub-pixel is inserted between the first theoretical sub-pixel and the adjacent theoretical sub-pixel arranged at a side of the first theoretical sub-pixel.

3. The driving method according to claim 2, wherein, when the first theoretical sub-pixel has two adjacent theoretical sub-pixels, virtual sub-pixels are inserted between the first theoretical sub-pixel and the adjacent theoretical sub-pixels arranged at both sides of the first theoretical sub-pixel.

4. The driving method according to claim 3, wherein, the virtual brightness value of the virtual sub-pixel is calculated according to the following formula:

$$V_{ni}=a_iT_1+b_iT_2, \text{ wherein,}$$

i=1, . . . , n;

n is the number of the virtual sub-pixel inserted between the first theoretical sub-pixel and one adjacent theoretical sub-pixel;

$V_{ni}$ is the virtual brightness value of the i-th virtual sub-pixel among the n virtual sub-pixels;

$a_i+b_i=1$, $a_i$, $b_i>0$, when $i<n/2$, $a_i>b_i$, when $i>n/2$, $a_i<b_i$, when $i=n/2$, $a_i=b_i$;

$T_1$ is the theoretical brightness value of the theoretical sub-pixel on the left side of the virtual sub-pixel to be calculated; and $T_2$ is the theoretical brightness value of the theoretical sub-pixel on the right side of the virtual sub-pixel to be calculated.

5. The driving method according to claim 4, wherein, when n=1, $V_{11}=½(T1+T2)$; and when n>1, $V_{n1}=½*(T_1+V_{(n-1)1})$, $V_{ni}=½*(V_{(n-1)(i-1)}+V_{(n-1)i})$ (1<i<n), and $V_{nn}=½*(T2+V_{(n-1)(n-1)})$.

6. The driving method according to claim 4, wherein, n is any one of 1 to 5.

7. The driving method according to claim 2, wherein, the virtual brightness value of the virtual sub-pixel is calculated according to the following formula:

$$V_{ni}=a_iT_1+b_iT_2, \text{ wherein,}$$

i=1, . . . , n;

n is the number of the virtual sub-pixel inserted between the first theoretical sub-pixel and one adjacent theoretical sub-pixel;

$V_{ni}$ is the virtual brightness value of the i-th virtual sub-pixel among the n virtual sub-pixels;

$a_i+b_i=1$, $a_i$, $b_i>0$, when $i<n/2$, $a_i>b_i$, when $i>n/2$, $a_i<b_i$, when $i=n/2$, $a_i=b_i$;

$T_1$ is the theoretical brightness value of the theoretical sub-pixel on the left side of the virtual sub-pixel to be calculated; and $T_2$ is the theoretical brightness value of the theoretical sub-pixel on the right side of the virtual sub-pixel to be calculated.

8. The driving method according to claim 7, wherein, when n=1, $V_{11}=½(T1+T2)$; and when n>1, $V_{n1}=½*(T_1+V_{(n-1)1})$, $V_{ni}=½*(V_{(n-1)(i-1)}+V_{(n-1)i})$ (1<i<n), and $V_{nn}=½*(T2+V_{(n-1)(n-1)})$.

9. The driving method according to claim 7, wherein, n is any one of 1 to 5.

10. The driving method according to claim 1, wherein, length of the theoretical sub-pixel in a longitudinal direction is equal to that of the actual sub-pixel in a longitudinal direction, and the horizontal-to-vertical ratio of each actual sub-pixel is 1:2 or 1:1.

11. The driving method according to claim 1, wherein, each actual pixel unit comprises three actual sub-pixels having colors different from each other, and the horizontal-to-vertical ratio of each actual sub-pixel is 2:3.

12. The driving method according to claim 11, wherein, the pixel array comprises a plurality of pixel unit sets, each of which comprises two adjacent actual pixel units in a same column, and left boundaries of the actual sub-pixels of the actual pixel unit in a lower row are aligned with midpoints of bottom boundaries of the actual sub-pixels of the actual pixel unit in an upper row.

13. The driving method according to claim 11, wherein, the pixel array comprises a plurality of pixel unit sets, each of which comprises two adjacent actual pixel units in a same column, and left boundaries of the actual sub-pixels of the actual pixel unit in an upper row are aligned with midpoints of top boundaries of the actual sub-pixels of the actual pixel unit in a lower row.

* * * * *